US005171550A

United States Patent [19]

Deininger et al.

[11] Patent Number: 5,171,550

[45] Date of Patent: Dec. 15, 1992

[54] PROCESS FOR REMOVING THALLIUM FROM LEAD BULLION

[75] Inventors: Lutz Deininger, Roetgen; Jiadong Hang; Juergen Heering, both of Aachen; Reinhard Hoehn, Stolberg; Joachim Krueger, Aachen, all of Fed. Rep. of Germany

[73] Assignee: Metallgesellschaft AG, Frankfurt am Main, Fed. Rep. of Germany

[21] Appl. No.: 835,032

[22] Filed: Feb. 7, 1992

Related U.S. Application Data

[63] Continuation of Ser. No. 543,593, Jun. 26, 1990, abandoned.

[30] Foreign Application Priority Data

Jul. 5, 1989 [DE] Fed. Rep. of Germany ..... 3922073

[51] Int. Cl.[5] ..... C22B 13/00; C22B 13/08

[52] U.S. Cl. ..... 423/92; 75/697; 75/701; 423/94

[58] Field of Search ..... 75/697, 701; 423/92, 423/94, 405

[56] References Cited

U.S. PATENT DOCUMENTS

| | | | |
|---|---|---|---|
| 2,956,871 | 10/1960 | Churrow et al. | 75/698 |
| 3,694,191 | 9/1972 | Lebedeff et al. | 75/701 |
| 4,425,160 | 1/1984 | Mehta et al. | 75/701 |
| 4,758,271 | 7/1988 | Zegers et al. | 75/701 |

FOREIGN PATENT DOCUMENTS

| | | | |
|---|---|---|---|
| 3631196 | 9/1986 | Fed. Rep. of Germany | 423/94 |
| 46715 | 3/1963 | Poland | 75/701 |

OTHER PUBLICATIONS

Chemical Abstract 89:63103u.
Chemical Abstract 89:201055h.

*Primary Examiner*—John Niebling
*Assistant Examiner*—Brian M. Bolam
*Attorney, Agent, or Firm*—Sprung Horn Kramer & Woods

[57] ABSTRACT

The thallium content of lead bullion is decreased in that iron chloride is stirred into the lead bullion so as to form a salt slag which contains thallium.

8 Claims, No Drawings

PROCESS FOR REMOVING THALLIUM FROM LEAD BULLION

This application is a continuation, of application Ser. No. 543,593, filed Jun. 26, 1990 now abandoned.

DESCRIPTION

This invention relates to a process of removing thallium from lead bullion wherein chlorides are stirred into the lead bullion and a thallium-containing salt slag is withdrawn.

Lead bullion which has been produced by pyrometallurgy has a thallium content which depends on the thallium content of the charge materials and on the smelting process. In the blast furnace process preceded by a sinterings and roasting treatment, a large part of the thallium contained in the charge materials is volatilized and is removed from the process with the fine dust. Another part of the thallium enters the slag in the blast furnace. As a result, the lead bullion has only a small thallium content. In more recent processes of recovering lead directly from sulfide ores without a previous separate roasting treatment, the fine dusts are recirculated and there is no removal of volatilized thallium with the fine dusts. The lead bullion produced by such processes may contain up to about 250 ppm thallium. Such a process for a direct recovery of lead has been described, e.g., in EP 003 853. In dependence on the quality of the refined lead, the thallium content of the lead bullion must be decreased to specified values.

From V. Tafel "Lehrbuch der Metallhüttenkunde", 2nd Edition, 1953, Volume 2, page 649, it is known that the thallium content of lead bullion can be reduced in that zinc chloride is stirred into the lead bullion so that a chloride-containing melt is obtained, which contains about 5% Tl, 11% Zn, 1.4% As and 7% Cl and which is strongly mixed with lead metal (50%).

JP-8-81/50,788 also discloses the removal of thallium from lead bullion in that zinc chloride is stirred into the lead bullion. Because zinc chloride is highly hygroscopic, it imposes high requirements regarding its storage and the addition of zinc chloride to the lead bullion involves a high risk of explosion. Besides, the zinc will enter the lead bullion as an impurity unless the lead is re-refined after the thallium has been removed.

From JP-8-86/6134 it is known to remove thallium from lead bullion in that lead chloride, ammonium chloride or a mixture of both salts is stirred into the lead bullion. But ammonium chloride will be volatilized even at relatively low temperatures. Lead chloride is highly expensive, evaporates easily and has only a small Cl content.

It is an object of the invention to avoid the disadvantages of the known processes and to provide an economical and technologically simple process by which thallium can substantially be removed from lead bullion.

That object is accomplished in accordance with the invention in that iron chloride in a quantity of 0.1 to 0.5% by weight, calculated as anhydrous $FeCl_2$, based on the lead bullion, is stirred into the lead bullion. The iron chloride may consist of iron(II) chloride or of a mixture of iron(II) chloride and iron(III) chloride. If the thallium content of the lead bullion is high and if a refining to very low thallium contents is required, iron chloride will be added in an amount in the upper portion of the range stated above. Small contents of or additions of lead chloride, zinc chloride, ammonium chloride or cooper chloride are permissible. The iron chloride may be used in dry form or may contain water of crystallization. The stirring of the iron chloride into the molten lead bullion and the stirring of the lead bullion are effected by the processes which are usual and known for refining lead. The stirring time required to decrease the thallium content to the desired residual value is empirically determined and will depend on the initial content of thallium in the lead bullion, on the size of the refining vessel and on the stirring mechanism. The salt slag which is formed may be removed in a liquid state from the surface of the lead bullion or said slag may previously be stirred in a dry state. An operation in two stages is also possible.

In accordance with a preferred feature, iron(II) chloride is stirred into the lead bullion. Iron(II) chloride has a higher decomposition temperature than iron(III) chloride and is less hygroscopic and has a much lower vapor pressure.

In accordance with a preferred feature, the $FeCl_2$ which is stirred into the lead bullion is obtained by the processing of waste acid from pickling baths. That iron chloride consists mainly of $FeCl_2.4H_2O$ and is highly suitable for the removal of thallium and constitutes an inexpensive waste product.

In accordance with a preferred feature the lead bullion is processed at a temperature of 470° C.±40° C. Very good results will be obtained in that temperature range.

In accordance with a preferred feature the lead bullion is stirred at a decreasing temperature when the iron chloride has been added. The iron chloride is stirred into the lead bullion when the latter is at a relatively high temperature and the stirring of the lead bullion is continued until the reaction is terminated while the temperature of the lead bullion decreases. This will produce particularly good results.

In accordance with a preferred feature, the iron chloride is added to the lead bullion after the latter has been dezinced in a vacuum. After the dezincing in a vacuum the lead bullion is at a temperature which is very favorable for the addition of the iron chloride. A low residual zinc content of the lead bullion after the dezincing in a vacuum, up to 0.1% Zn, will be desirable.

In accordance with a preferred feature the treatment is carried out in two stages. Fresh iron chloride must be stirred into the lead bullion in the second stage. The salt slag which has been formed must be skimmed in time in each stage in order to prevent a redissolution of thallium from the salt slag into the lead. That processing in two stages may result in particularly low residual contents.

In accordance with a preferred feature the salt slag which has been skimmed off in the second stage is used in the first stage. As a result, the salt slag obtained in the first slag will have a relatively high thallium content and can be more easily be processed for a recovery of thallium.

Thallium can be recovered from the salt slags by known processes.

From Published German Application 36 31 196 it is known that thallium can be removed by an addition of metal chlorides and chlorine gas in a plurality of stages at temperatures between 350° and 450° C. and with a small total surplus based on the thallium content. The molten thallium-containing chloride formed after each stage is entirely removed from the molten metal after each stage. If a final thallium content below 10 ppm is desired, two to four equivalents of chloride, based on the stoichiometric requirement, are added. The metal chlorides which may be added allegedly include numerous chlorides of divalent metals, such as the chlorides of magnesium, manganese, iron, cobalt, and nickel. But it is not stated there that said chlorides are of high significance because preferably zincchloride and chlorine gas are used, whereby with the chlorine gas lead chloride is formed, and zinc chloride or a mixture of zinc chloride and lead chloride is used in the examples.

The invention will be explained more in detail with reference to examples.

EXAMPLE 1

3.5 kg lead bullion were melted and heated to 450° C. in a crucible. The lead bullion contained 250 ppm thallium. 20 g $FeCl_2.4\ H_2O$ were stirred into the molten material, which was then stirred for 30 minutes. 23 g salt slag were subsequently skimmed off. The lead contained 35 ppm thallium. The salt slag contained 1.94% Tl, 15.30% Fe, 59.70% Pb, 11.10% Zn and 17.8% Cl. 20 g $FeCl_2.4H_2O$ were then added into the remaining molten lead, which was then stirred for further 30 minutes. 22 g salt slag were then skimmed off. The lead still contained 8 ppm Tl. The salt slag contained 1.04% Tl, 13.60% Fe, 54.20% Pb, 4.70% Zn and 15.3% Cl. The quantities of Tl, Fe and Cl required for a balance adhered to the rim of the crucible or had been evaporated.

EXAMPLE 2

530 gk lead bullion were melted and heated to 470° C. in an experimental vessel provided with a stirring mechanism. The lead contained 130 ppm thallium. 1865 g $FeCl_2.4H_2O$ were stirred into the molten material, which was heated further and subsequently cooled with constant stirring. A salt slag was thus formed, which was initially entirely molten and became pasty as it was cooled.

The thallium content of the lead changed in dependence on the temperature and on the stirring time as follows:

| Temperature (°C.) | Time (minutes) | Tl content (ppm) |
|---|---|---|
| 470 | 0 | 130 |
| 499 | 8 | 31 |
| 496 | 13 | 24 |
| 473 | 20 | 21 |
| 437 | 32 | 17 |

2,400 g salt slag were obtained, which contained 1.83% Tl, 50.3% Pb, 0.69% Zn and 18.3% Fe.

The molten lead was reheated to 475° C., and 1000 g $FeCl_2.4\ H_2O$ were added to and stirred into the molten lead. The molten material was again first heated and then cooled with constant stirring. Additional 1440 g salt slag were then skimmed off, which contained 0.58% Tl, 50.8% Pb, 0.17% Zn and 19.1% Fe.

The thallium content of the lead changed as follows: (The higher thallium content at the beginning was due to a redissolution from salt slag which was still present after the first processing stage.)

| Temperature (°C.) | Time (minutes) | Tl content (ppm) |
|---|---|---|
| 475 | 0 | 24 |
| 500 | 7 | 11 |
| 493 | 27 | 12 |
| 456 | 50 | 13 |

EXAMPLE 3

147 kg lead bullion were melted and heated to 460° C. in an experimental vessel provided with a stirring mechanism. The lead contained 96 ppm thallium and 380 ppm zinc. 900 g $FeCl_2.4\ H_2O$ were stirred into the molten lead. After the molten lead had been stirred for 30 minutes, 1.3 kg lead-containing salt slag, which contained 0.85% thallium, were skimmed off. The lead had residual contents of 3.2 ppm thallium and less than 5 ppm zinc.

EXAMPLE 4

140 kg lead bullion were melted and heated to 470° C. in an experimental vessel provided with a stirring mechanism. The lead contained 77 ppm thallium and 320 ppm zinc. 920 g of the salt slag form Example 3 were stirred into the molten lead. After the molten lead had been stirred for 30 minutes, 950 g salt slag, which contained 1.66% Tl, were skimmed off. The lead contained 10 ppm Tl and less than 5 ppm zinc.

The advantages afforded by the invention reside in that the thallium content can be substantially entirely removed with the aid of an additive which is relatively inexpensive and can be handled simply and which will not contaminate the lead. The addition in the amount stated resulted in an effective removal of the thallium from the lead bullion without a need for an addition in an unnecessarily large surplus.

We claim:

1. In the removal of thallium from lead bullion wherein chlorides are stirred into the lead bullion and a thallium-containing salt slag is withdrawn, the improvement which comprises in a single step reducing the thallium content to about 10 ppm or less by stirring into the lead bullion iron chloride in a quantity of 0.1 to 0.5% by weight, calculated as anhydrous $FeCl_2$, based upon the lead bullion, at a lead bullion temperature of 470° C. ±40° C.

2. A process according to claim 1, wherein iron (II) chloride is stirred into the lead bullion.

3. A process according to claim 1, wherein $FeCl_2$ obtained by processing of waste acids from pickling baths is stirred into the lead bullion.

4. A process according to claim 1, wherein the lead bullion is processed at a temperature of 470° C. ±40° C.

5. A process according to claim 1, wherein the lead bullion is stirred at a decreasing temperature after the iron chloride has been added.

6. A process according to claim 1, wherein the iron chloride is added to the lead bullion after the bullion has been dezinced in a vacuum.

7. A process according to claim 1, wherein the lead bullion is processed at a temperature of at least about 470° C.

8. A process according to claim 1, wherein the lead bullion is processed at a temperature of about 470° C.

* * * * *